United States Patent [19]

Hall et al.

[11] 4,312,528

[45] Jan. 26, 1982

[54] PANIC BOLT ASSEMBLY

[75] Inventors: John L. Hall, Maidenhead; Anthony S. Peck, Belper, both of England

[73] Assignee: PLC Engineering Company Limited, London, England

[21] Appl. No.: 91,888

[22] Filed: Nov. 7, 1979

[51] Int. Cl.[3] ..... E05C 15/02

[52] U.S. Cl. ..... 292/92; 292/168; 292/336.3

[58] Field of Search ..... 292/21, 92, 93, 336.3, 292/168

[56] References Cited

U.S. PATENT DOCUMENTS

| | | | |
|---|---|---|---|
| 1,059,555 | 4/1913 | Money | 292/93 |
| 1,898,505 | 2/1933 | Solmer | 292/92 |
| 3,024,053 | 3/1962 | Cox et al. | 292/92 X |
| 4,113,292 | 9/1978 | Gauron et al. | 292/336.3 |

*Primary Examiner*—Richard E. Moore

*Attorney, Agent, or Firm*—Buell, Blenko, Ziesenheim & Beck

[57] ABSTRACT

In a panic bolt assembly for use on an emergency exit door, a horizontal elongate operating device comprises two elongate bodies hinged together along adjoining horizontal edges. Each body is pivotally mounted on the door about a horizontal axis adjacent the edge of the body remote from the hinged edges. At least one of these pivoted edges is constrained to move vertically with respect to the door to effect engagement or disengagement of a bolt of the door. Pressure imparted to the hinged edges of the device in a direction towards the door effects vertical movement of the pivoted edge or edges to disengage the bolt or bolts.

5 Claims, 5 Drawing Figures

PANIC BOLT ASSEMBLY

Figure 1:
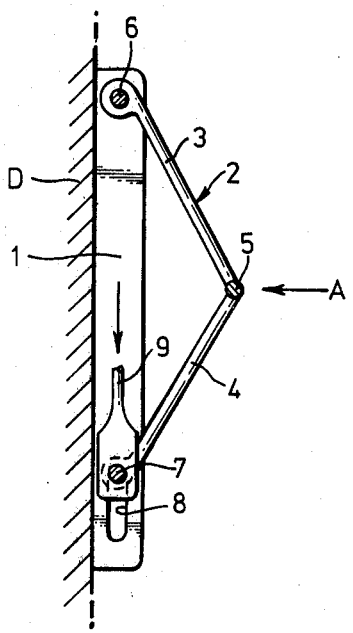

This invention relates to bolt assemblies for use on emergency exit doors in buildings and is particularly concerned with a bolt assembly of the kind in which vertical movement of a bolt at the top and/or bottom of the vertical edge of a door remote from the hinged vertical edge is effected by pressure, in the direction of opening movement of the door, on an operating bar or other elongate operating device which is mounted substantially horizontally across the width of the door, usually at about waist height. A bolt assembly of this kind will hereinafter be referred to as a "panic bolt assembly".

In a known form of panic bolt assembly that is in wide-spread use, the substantially horizontal operating bar is so mounted that it is spaced from one vertical face of the door and, when appropriate pressure has been applied to the operating bar to disengage the bolt or bolts, a minimum clearance (usually about 55 mm) is maintained between the bar and the face of the door to ensure that effective operation of the panic bolt assembly cannot be prevented by fingers, hands or other obstruction becoming trapped between the bar and the face of the door. In order to ensure that the aforesaid minimum clearance of the operating bar is provided when the panic bolt assembly has been fully operated, when the door is closed and the bolt or bolts is or are fully engaged the operating bar must be initially spaced a substantial distance from the face of the door, usually about 125 mm.

It is an object of the present invention to provide an improved panic bolt assembly in which the distance that the substantially horizontal elongate operating device is spaced from the face of a door when the bolt or bolts is or are fully engaged is substantially less than that in panic bolt assemblies hitherto proposed and used and in which the risk that fingers, hands or other obstruction may become trapped between the operating device and the face of a door and so prevent effective operation of the panic bolt assembly is substantially eliminated.

According to the invention, in the improved panic bolt assembly the substantially horizontal elongate operating device comprises two elongate bodies hinged together along adjoining substantially horizontal edges, each of which bodies is, or is adapted to be, pivotally mounted on the door about a substantially horizontal axis adjacent the edge of the body that is remote from said hinged edges and at least one of which pivoted edges is constrained to move substantially vertically with respect to the door to effect engagement or disengagement of a bolt, the arrangement being such that pressure imparted to the hinged edges of the operating device in a direction towards the door effects vertical movement of said pivoted edge or edges to disengage said bolt or bolts.

Since the pivoted edge of one or each elongate body is constrained to move substantially vertically, the distance that said pivoted edge is spaced from the face of the door is substantially constant and, consequently, the extremity of each pivoted edge can be arranged to lie close to the face of the door, thereby substantially eliminating any risk of fingers or other obstruction preventing effective operation of the panic bolt assembly.

Preferably, each of the elongate bodies is a substantially flat plate of metal or other suitable substantially rigid material.

The hinged connection between adjoining edges of the two flat plates or other elongate bodies may take any convenient form, e.g. "piano" hinge, but with a view to eliminating any risk that a part of a hand of a user may be pinched in the hinged connection, preferably the hinged connection is shrouded by a separately formed elongate cover which is pivotally mounted on each plate or other elongate body and which may be of such a shape as to form a handle for use when closing the panic bolt assembly. In a preferred embodiment, the adjoining edges of the two flat plates or other elongate bodies have toothed, substantially arcuate surfaces which interengage to form the hinged connection, the hinged connection being shrouded by a separately formed elongate cover pivotally mounted on each plate or other elongate body; a preferred hinge connection of this kind is that manufactured and sold by Indalex Limited under the trade name "Roton."

The pivot of the or each vertically movable pivoted edge of the operating device may be integral with or connected directly to the associated bolt but, where, as is preferred, the bolt is concealed in a substantially vertical elongate compartment in or on the door, preferably the associated pivoted edge of the operating device is coupled to the bolt by an appropriate linkage which is at least partly concealed in the elongate compartment.

The invention also includes a kit of parts for use in making an improved panic bolt assembly as hereinbefore described.

Figure 4:
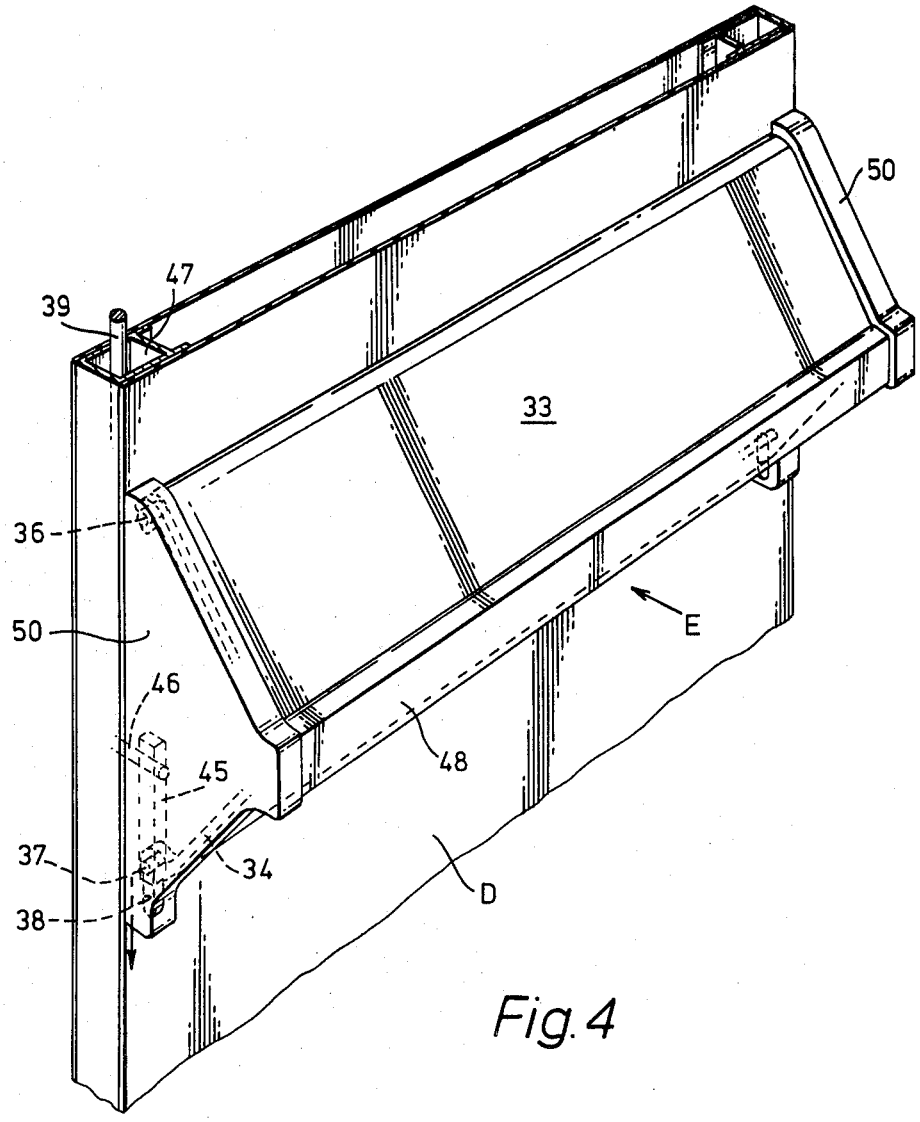
Figure 5:
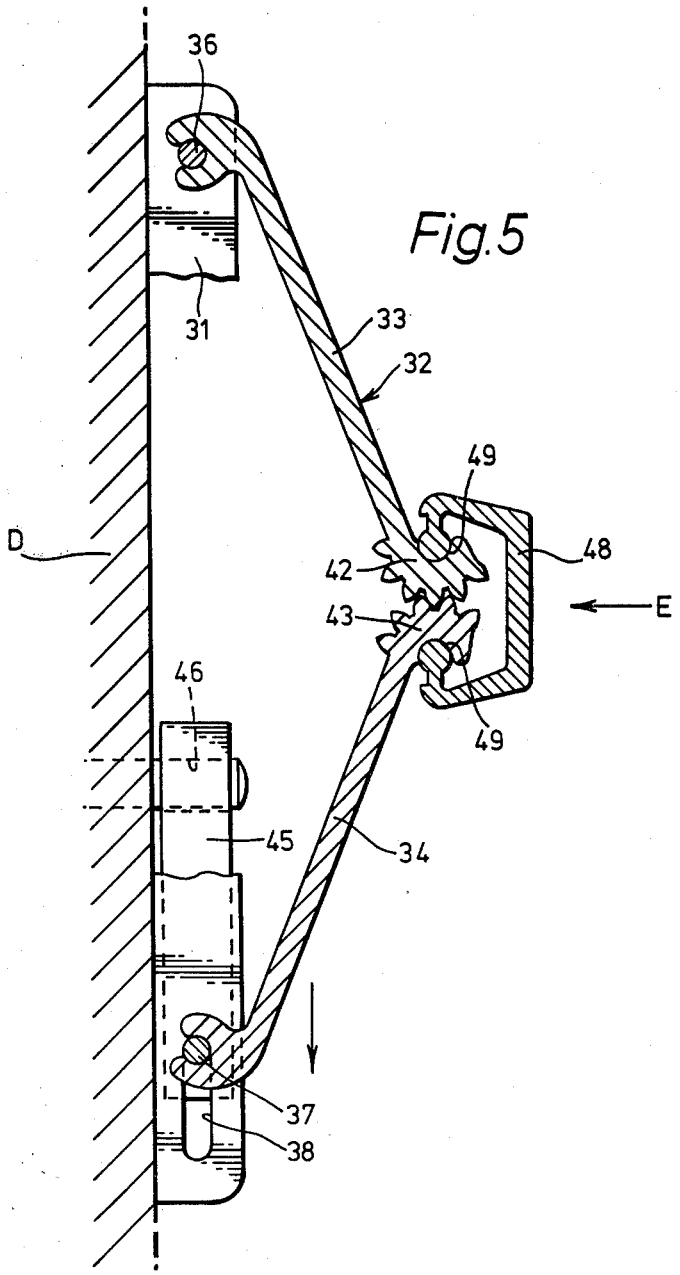

The invention is further illustrated by a description, by way of example, of three basic forms of the improved panic bolt assembly and of the preferred panic bolt assembly, with reference to the accompanying drawings, in which:

FIGS, 1, 2 and 3 are diagrammatic side views of the three basic forms of panic bolt assembly, and FIGS. 4 and 5, respectively, are perspective and sectional side views of the preferred panic bolt assembly.

In the panic bolt assembly shown in FIG. 1, a door D has a pair of vertical guides 1, of which one only is shown, one guide being secured to one face of the door adjacent one vertical edge of the door and the other guide being secured to the door adjacent is other vertical edge. A horizontal elongate operating device 2 comprises two elongate flat metal plates 3, 4 hinged together at 5 along adjoining horizontal edges, the upper edge of the plate 3 being pivotally mounted at 6 on the guides 1 and each end of the lower edge of the plate 4 being pivotally mounted on a pin 7 constrained to slide in a groove 8 in the guide 1. Secured to the pin 7 which is slidably mounted in the groove 8 in the guide 1 remote from the hinged vertical edge of the door, is the lower end of a vertical rod 9 whose upper end constitutes the bolt of the door adjacent its upper edge. When an operating force is applied to the hinged connection 5 in the direction of the arrow A, the plates 3,4 pivot about their pivotting axes and the pin 7 is constrained to slide downwardly in the slot 8 to disengage the bolt 9 and so permit the door to open.

Figure 2:
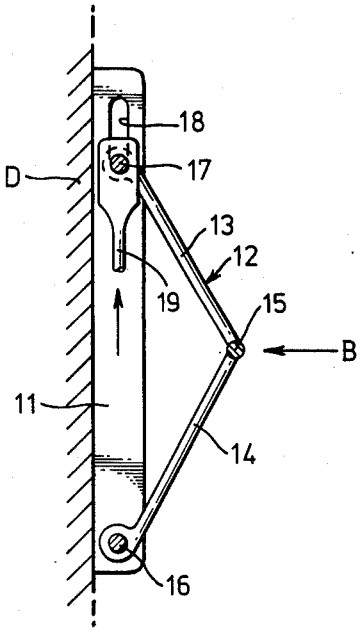

In the panic bolt assembly shown in FIG. 2 the components corresponding to those of the panic bolt assembly shown in FIG. 1 have been given a reference greater by ten than that of the corresponding component in FIG. 1. In this case, however, the lower end of the plate 14 is pivotally mounted at 16 in the guides 11 and each end of the upper edge of the plate 13 is pivotally mounted on a pin 17 constrained to slide in a groove 18 in the guide 11. A rod 19 is secured to and depends downwardly from the pin 17 on the guide 11 remote from the hinged edge of the door, the lower end of the rod constituting the bolt of the door adjacent its lower edge. When an operating force is applied to the hinged connection 15 in the direction of the arrow B, the plates 13, 14 pivot about their pivotting axes and the pin 17 is constrained to slide upwardly to disengage the bolt 19 and so permit the door to open.

Figure 3:
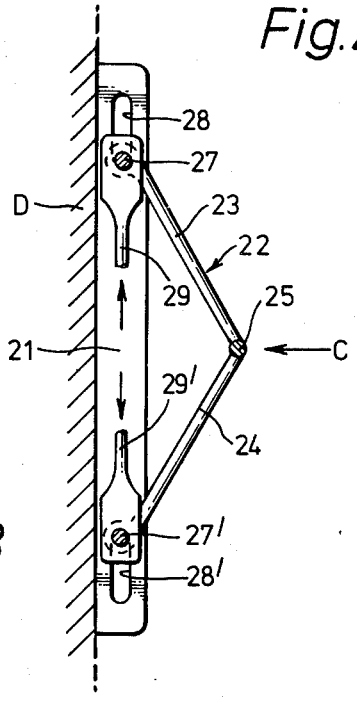

The panic bolt assembly shown in FIG. 3 is suitable for use where a door D has bolts adjacent both its upper and lower edges. Components corresponding to those of the panic bolt assembly shown in FIG. 1 have been given a reference greater by twenty than that of the corresponding component in FIG. 1. In this case, each end of the upper edge of the plate 23 is pivotally mounted on a pin 27 constrained to slide in a groove 28 in the guide 21 and each end of the lower edge of the plate 24 is pivotally mounted on a pin 27' constrained to slide in a groove 28' in the guide 21. The pin 27 on the guide 21 remote from the hinged edge of the door D has a rod 29 depending downwardly from the pin and constituting at its lower end one of the bolts of the door and the pin 27' on the same edge of the door supports an upwardly extending rod 29' whose upper end constitutes the other bolt of the door. When an operating force is applied to the hinged connection 25 in the direction of arrow C, the plates 23, 24 pivot about their pivotting axes, the pin 27 being constrained to slide upwardly to raise the bolt 29 and the pin 27' being constrained to slide downwardly to lower the bolt 29' and so permit the door to open.

The preferred panic bolt assembly shown in FIGS. 4 and 5 operates on the same principle as described with reference to FIG. 1. Two substantially flat metal plates 33, 34 constituting the operating device 32 of the assembly are hinged together along their adjoining edges by inter-engaging tooth arcuate parts 42, 43 which constitute the hinged connection. The upper edge of plate 33 is pivotally mounted at 36 on guides 31 extending alongside the vertical edges of the door D. Each end of the lower edge of the plate 34 is pivotally mounted on a pin 37 constrained to slide in a groove 38 in the guide 31. Upstanding from the pin 37 adjacent the edge of the door D remote from the hinged edge of the door, is a link 45 which carries at its upper end a pin 46. The pin 46 passes through a vertical groove in the face of the door D and is secured to a vertical rod 39 which is housed in an elongate component 47 in the door frame and which constitutes, at its upper end, the bolt of the door adjacent its upper edge.

The hinged connection between the arcuate parts 43, 44 is shrouded by an elongate cover 48 which is pivotally mounted ith respect to each plate 33, 34 at 49. Each guide 31 and the adjacent end of the cover 48 is shrouded by a housing 50.

When an operating force is applied to the elongate cover 48 in the direction of arrow E (FIG. 5), the plates 33, 34 pivot about their pivotting axes and the pin 37 and link 45 are constrained to move downwardly to disengage the bolt 39 and so permit the door to open.

What we claim as our invention is:

1. A panic bolt assembly for use on an emergency exit door, which panic bolt assembly comprises a bolt mounted on the door at at least one end of the vertical edge of the door remote from the hinged vertical edge and constrained to move substantially vertically with respect to the door and, operatively coupled to the bolt, a substantially horizontal elongate operating device which is mounted substantially horizontally across the width of the door and which comprises two substantially horizontal elongate bodies arranged alongside one another and having along adjacent substantially horizontal edges toothed substantially arcuate surfaces which inter-engage to form a hinged connection, each of which elongate bodies is pivotally mounted on the door about a substantially horizontal axis adjacent the edge of the elongate body that is remote from said hinged connection and at least one of which pivoted edges is constrained to move substantially vertically with respect to the door to effect engagement or disengagement of said bolt, and a separately formed elongate cover pivotally mounted on each elongate body and shrouding said hinged connection, the arrangement being such that pressure imparted to the hinged connection of the operating device in a direction towards the door effects vertical movement of said pivoted edge or edges to disengage said bolt.

2. A panic bolt assembly for use on an emergency exit door, which panic bolt assembly comprises a bolt mounted on the door at at least one end of the vertical edge of the door remote from the hinged vertical edge and constrained to move substantially vertically with respect to the door and, operatively coupled to the bolt, a substantially horizontal elongate operating device which is mounted substantially horizontally across the width of the door and which comprises two substantially flat elongate plates of substantially rigid material arranged alongside one another and having along adjacent substantially horizontal edges toothed substantially arcuate surfaces which inter-engage to form a hinged connection, each of which plates is pivotally mounted on the door about a substantially horizontal axis adjacent the edge of the plate that is remote from said hinged connection and at least one of which pivoted edges is constrained to move substantially vertically with respect to the door to effect engagement or disengagement of said bolt, and a separately formed elongate cover pivotally mounted on each plate and shrouding said hinged connection, the arrangement being such that pressure imparted to the hinged connection of the operating device in a direction towards the door effects vertical movement of said pivoted edge or edges to disengage said bolt.

3. A panic bolt assembly as claimed in claim 1 or 2, wherein the separately formed elongate cover is of such a shape as to form a handle for use when closing the panic bolt assembly.

4. A panic bolt assembly as claimed in claim 1 or 2, wherein said bolt is concealed in a substantially vertical elongate compartment and the associated pivoted edge of the operating device is coupled to the bolt by an appropriate linkage which is at least partly concealed in the elongate compartment.

5. A panic bolt assembly as claimed in claim 1 or 2, wherein only the pivoted edge of the lower flat plate or other elongate body is constrained to move substantially vertically with respect to the door to effect engagement or disengagement of said bolt.

* * * * *